United States Patent [19]

Winter

[11] 4,039,850

[45] Aug. 2, 1977

[54] VOLTAGE CONVERTER

[75] Inventor: Arthur J. Winter, Encino, Calif.

[73] Assignee: Fairchild Camera and Instrument Corporation, Mountain View, Calif.

[21] Appl. No.: 687,429

[22] Filed: May 17, 1976

[51] Int. Cl.[2] ..... G08B 5/36

[52] U.S. Cl. ..... 307/11

[58] Field of Search ..... 307/11, 17, 30, 31, 307/32; 340/332; 350/160 LC; 321/2 R

[56] References Cited

U.S. PATENT DOCUMENTS 3,384,803 5/1968 Hardin et al. ..... 307/11

3,842,411 10/1974 Naito ..... 340/332

*Primary Examiner*—Herman Hohauser

*Attorney, Agent, or Firm*—Alan H. MacPherson; Henry K. Woodward; Norman E. Reitz

[57] ABSTRACT

An AC to DC voltage converter provides both regulated and unregulated voltage from the positive DC voltage output terminal which is connected to a power input terminal of a load. One load circuit is returned to a common circuit terminal (e.g. ground) and another load circuit is returned to the converter whereby the regulator is by-passed.

8 Claims, 3 Drawing Figures

VOLTAGE CONVERTER

BACKGROUND OF THE INVENTION

This invention relates generally to voltage converter circuits and more particularly to voltage converters for use with light emitting diode (LED) displays.

The use of LED displays is finding wide application in electrical instrumentation. Typically, a decoder-driver circuit receives a data input in digital code, decodes the input, and drives the LED display in response thereto.

In such electrical instrumentation, a regulated DC voltage is required for operating the digital circuitry and a voltage regulator is employed with AC to DC voltage conversion means to provide the regulated DC voltage from an AC voltage source.

Some power dissipation is associated with use of a voltage regulator, and heretofore the power dissipation has been increased substantially by driving the LED display from the regulated voltage output. One suggested circuit modification for reducing the regulator current and attendant power loss is the use of a transformer with a center taped secondary winding and connecting the LED display to the center tap and a common circuit terminal (e.g., ground) thereby completely bypassing the voltage regulator. A separate power terminal is required for applying DC voltage to the decoder logic circuitry.

However, some commercially available decoder-driver circuits have a single power input terminal for both the LED display and decoder. Typical of such circuits is the Fairchild FCI 34511 CMOS Latch Decoder-Driver.

SUMMARY OF THE INVENTION

In accordance with the present invention, a voltage converter circuit provides regulated voltage to an LED decoder-driver for digital circuit operation and unregulated voltage for driving the LED display whereby unnecessary regulated current is avoided. A preferred embodiment of the the converter circuit includes a transformer with center tapped secondary winding, a voltage rectifier, and a voltage regulator which is interconnected between the negative terminal of the rectifier and a common circuit terminal. The positive converter terminal is applied to the decoded-driver and current for the decoder logic flows from this terminal to the common circuit terminal and through the regulator for regulated voltage operation. The positive terminal is applied through the driver and the LED display to the center tap of the transformer secondary winding, thereby avoiding the voltage regulator. Consequently, the output voltage terminal of the converter circuit is applied to the decoder-driver but regulated voltage is applied only to the logic circuitry and not to the LED display.

Rather than using a center-tapped transformer the display can be connected to the converter bridge, avoiding the regulator, but increased filter current is drawn.

The invention and objects and features thereof will be more readily apparent from the following detailed description and appended claims when taken with the drawings.

DESCRIPTION OF THE ILLUSTRATED EMBODIMENTS

Figure 1:
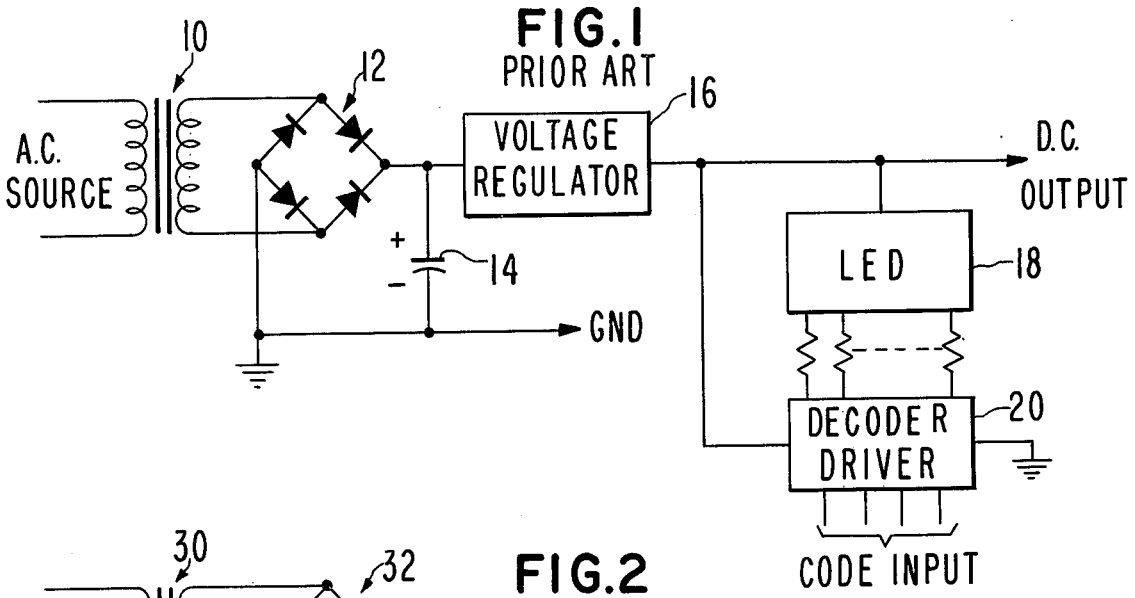
FIG.1 PRIOR ART
FIG. 1 is an electrical schematic of a conventional voltage converter and regulator circuit for an LED display.

Referring the the Drawings, FIG. 1 is an electrical schmetic of one embodiment of a conventional voltage converter and regulator circuit for a LED display and decoder-driver. Voltage from an alternating current (AC) voltage source is applied to the primary winding of transformer 10 and a full-wave diode rectifier 12 is connected to the secondary winding of transformer 10. Typically, transformer 10 will step down the AC voltage whereby a smaller DC voltage (e.g. + 5 volts) may be derived from the full-wave rectifier 12. The negative terminal of bridge 12 is connected to a common circuit terminal (e.g. ground) and a filter capacitor 14 is connected between the positive terminal of the bridge 12 and circuit ground. Voltage regulator 16 is serially connected between the positive terminal of the recitfier 12 and provides the regulated output voltage, e.g., +5 volts.

Conventionally the regulated output voltage powers the various circuitry of the electrical instrumentation including a light emitting diode display 18 and a decoder-driver 20. Thus, the LED display current flows through the voltage regulator and the display driver 20 to ground which increases the power loss in the voltage regulator, as described hereinabove. Since the LED displays draw a relatively high current and since the displays do not require a regulated voltage source, the connection of the LED to the voltage regulator results in an unnecessary loss of power in the voltage regulator due to the display current.

One proposed alternative to reducing the power loss in the voltage regulator due to the display current is to remove the display from the voltage regulator circuit. The display is connected between the center tap to the secondary winding of the transformer and circuit ground, however a second terminal is required for providing DC voltage to the decoder logic circuitry. Many commercially available decoder-driver circuits have a single power terminal and cannot operate with the proposed alternative circuit.

Figure 2:
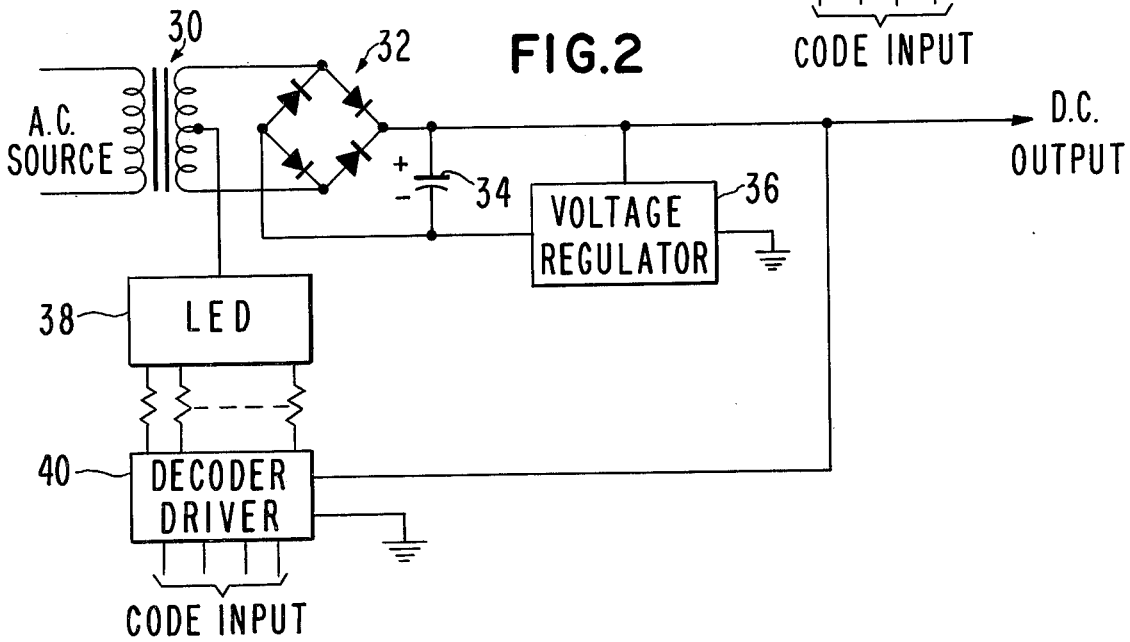
FIG. 2 is an electrical schematic of one embodiment of a voltage converter and regulator circuit for an LED display in accordance with the present invention.

FIG. 2 is an electrical schematic of one embodiment of a converter circuit in accordance with the present invention wherein a DC voltage is applied to a single power input of the decoder-driver which is regulated for the digital circuit operation but is not regulated for the LED display operation. An AC source is again connected to the primary of a transformer 30, a full-wave rectifier 32 is connected to the terminals of the secondary winding of transformer 30, and a filter capacitor 34 is connected across the positive and negative terminals of the full-wave rectifier 32. However, in this embodiment voltage regulator 36 is connected serially between the negative side of full-wave rectifier 32 and circuit ground rather than in the positive line from full-wave rectifier 32. A regulated DC voltage (e.g., +5 volt) is again obtained between the output of the converter and the common circuit or ground terminal; however, current from the output terminal which does not flow back to circuit ground does not pass through voltage regulator 36.

The 5-volt DC output is connected to decoder-driver 20 with the digital logic circuitry of the decoder being connected to circuit ground thereby operating from the 5 volt regulated supply. However, the LED display 38 is connected back to a center tap on the secondary winding of transformer 30 thereby providing a circuit which bypasses circuit ground and accordingly not drawing current through the voltage regulator 36. Thus, while the input terminal to decoder driver 40 is connected to the 5 volt output of the converter, only the current passing through the digital logic circuitry to circuit ground is drawn from voltage regulator 36; the current for energizing display 38 returns to the converter through transformer 30, thereby bypassing the voltage regulator 36.

A center-tapped transformer is not essential as the display can be connected to the negative terminal of the bridge rectifier, which avoids drawing current through the regulator. However, the filtered current is increased thereby requiring large capacity filter components and increasing filter power loss.

All components of the circuit are conventional and readily available. In a preferred embodiment the voltage regulator is a Fairchild FCI79MO5 regulator and the decoder-driver is a Fairchild FCI34511 CMOS circuit. The LED display is a Fairchild FND 500 numeric display.

Figure 3:
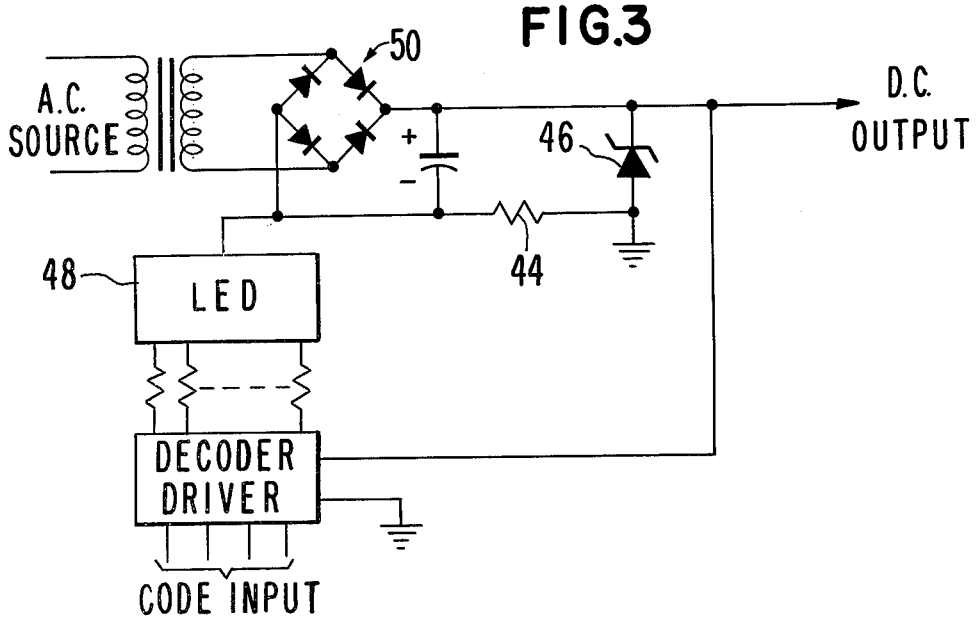
FIG. 3 is an electrical schematic of another embodiment of a voltage converter and regulator circuit for an LED display in accordance with the present invention.

Depending on output power requirements, the voltage regulator can be replaced by a serial resistor 44 connected between the negative bridge terminal and circuit ground and a zener diode 46 connected between circuit ground and the positive bridge terminal, as shown in FIG. 3. In the embodiment of FIG. 3 the LED display 48 also is connected to the negative terminal of the bridge 50 rather than to the transformer, as hereinabove described.

The voltage converter in accordance with the present invention enables the application of either regulated or unregulated voltage from the output terminal of the converter circuit to a single power input terminal depending on whether the circuit is returned to ground or back to another portion of the converter circuit which bypasses the regulator. While the invention has been described with reference to a specific embodiment, the description is for illustration purposes only and is not to be construed as limiting the scope of the invention. Various modifications and changes may occur to those skilled in the art without departing from the true spirit and scope of the invention as defined by the appended claims.

I claim:

1. A voltage converter circuit for generating a regulated direct current voltage from an alternating current voltage source and supplying the regulated voltage to a load-utilizing regulated and unregulated voltage whereby regulated current is minimized, comprising:

a. an alternating current voltage source;

b. transformer means having a primary winding with two input terminals, a secondary winding with two input terminals;

c. means connecting said alternating current voltage source to said two transformer input terminals;

d. a full-wave rectification bridge having two input terminals for receiving alternating current voltage and two output terminals for producing rectified alternating current voltage, a first output terminal of said bridge being more positive than said second bridge output terminal;

e. voltage regulator means interconnecting said second bridge terminal and a common circuit terminal and interconnected with said first bridge terminal whereby voltage across said common circuit terminal and said first bridge terminal is regulated;

f. load means having a common circuit terminal, input terminal means for receiving input voltage, and a load output voltage; and, g. means interconnecting said first bridge output terminal to said load input terminal means, and means interconnecting said load output terminal to said converter whereby said voltage regulator means is by-passed.

2. A voltage converter circuit as defined in claim 1 wherein said load means comprises a light emitting diode display and a driver-decoder, said light emitting diode display being operable from unregulated voltage and said driver-decoder being operable from regulated voltage.

3. A voltage converter circuit as defined in claim 2 wherein said driver-decoder comprises CMOS circuitry.

4. A voltage converter circuit as defined in claim 3 wherein said load input terminal means comprises a single voltage receiving terminal.

5. A voltage converter circuit as defined in claim 4 wherein said driver-decoder includes code input terminals.

6. A voltage converter circuit as defined by claim 1 wherein said secondary winding of said transformer means includes a center tap and means interconnects said load output terminal to said center tap.

7. A voltage converter as defined by claim 1 wherein means interconnects said load output terminal to said second bridge output terminal.

8. A voltage converter circuit for a light-emitting diode display and decoder-driver circuit comprising a transformer having a center taped secondary winding and two secondary winding terminals, rectification means connected to said two secondary winding terminals for producing rectified voltage on two rectifier output terminals, a voltage regulator interconnected between a first rectifier output terminal and a common circuit terminal, means interconnecting said decoder-driver to the second rectifier output terminal and to said common circuit terminal, and means interconnecting said light emitting diode display to the center tap of said transformer secondary winding whereby regulated voltage is applied to operate said decoder-driver and unregulated voltage is applied to drive said light emitting diode display.

* * * * *